US008397438B2

(12) United States Patent
Hoy et al.

(10) Patent No.: US 8,397,438 B2
(45) Date of Patent: Mar. 19, 2013

(54) FLASHING BOOTS FOR ROOF PENETRATIONS

(75) Inventors: Mike Hoy, Lake Placid, FL (US); Jack Edgemon, Lake Placid, FL (US); John Hoy, Lake Placid, FL (US)

(73) Assignee: Heartland Metals, Inc., Lake Placid, FL (US)

( * ) Notice: Subject to any disclaimer, the term of this patent is extended or adjusted under 35 U.S.C. 154(b) by 919 days.

(21) Appl. No.: 11/580,178

(22) Filed: Oct. 12, 2006

(65) Prior Publication Data

US 2007/0101664 A1 May 10, 2007

Related U.S. Application Data

(66) Substitute for application No. 60/725,753, filed on Oct. 12, 2005.

(51) Int. Cl.
*E04D 1/36* (2006.01)

(52) U.S. Cl. ..... 52/58; 52/60; 52/198; 52/97; 52/220.8; 52/302.1; 285/43

(58) Field of Classification Search ..... 52/58, 60, 52/198, 199, 219, 97, 244, 220.8, 300, 302.1, 52/302.6, 302.7; 285/42, 43, 44, 45
See application file for complete search history.

(56) References Cited

U.S. PATENT DOCUMENTS 1,202,687 A * 10/1916 Elkerton ..... 285/13
1,317,574 A * 9/1919 Grosvold ..... 285/44
1,615,929 A * 2/1927 Buckles et al. ..... 285/43
1,678,715 A * 7/1928 Stephenson ..... 285/44
1,923,220 A * 8/1933 Lightbown ..... 285/13
3,098,663 A * 7/1963 Dibley ..... 285/43
3,313,559 A * 4/1967 Kifer ..... 285/43
3,436,880 A * 4/1969 Kifer ..... 52/58
3,677,576 A * 7/1972 Gustafson ..... 285/43
3,797,181 A * 3/1974 Nievelt ..... 52/105
4,010,578 A * 3/1977 Logsdon ..... 52/58
4,265,058 A * 5/1981 Logsdon ..... 52/58
4,442,643 A * 4/1984 Stadheim ..... 52/219
4,563,847 A 1/1986 Hasty
4,652,321 A * 3/1987 Greko ..... 156/165
4,768,812 A 9/1988 Katz
4,897,974 A * 2/1990 Lane ..... 52/199
5,010,700 A * 4/1991 Blair ..... 52/199
5,176,408 A 1/1993 Pedersen
5,226,263 A * 7/1993 Merrin et al. ..... 52/58
5,536,048 A * 7/1996 Orr ..... 285/42
5,588,267 A 12/1996 Rodriguez et al.
5,694,724 A 12/1997 Santiago
5,970,667 A 10/1999 Thaler
6,244,006 B1 * 6/2001 Shue et al. ..... 52/302.1
6,279,272 B1 8/2001 Nill, Jr.
6,640,503 B1 11/2003 Evensen et al.
6,691,473 B1 2/2004 Mayle et al.
6,945,000 B1 9/2005 Hohmann et al.

(Continued)

*Primary Examiner* — Joshua J Michener
*Assistant Examiner* — Chi Nguyen
(74) *Attorney, Agent, or Firm* — Mark D. Bowen; Malin Haley DiMaggio & Bowen, P.A.

(57) ABSTRACT

Flashing systems for use with metal and non-metal roof systems are provided having a generally planar lead base defining an aperture, a generally cylindrical structure attached to the base in surrounding relation with the aperture and projecting upward therefrom, and an adhesive sealing membrane attached to the bottom of the base for connecting the flashing to a roof. A flexible plastic downspout allows flashing system to adapt to various roof slope and roof penetration configurations. The downspout may be include a plurality of diametrically reducing stepped sections such that the installing technician is able to simply cut the stepped plastic downspout to the size that will accommodate the roof penetration pipe.

2 Claims, 15 Drawing Sheets

U.S. PATENT DOCUMENTS 7,114,301 B2 * 10/2006 Bibaud et al. ..... 52/219
7,775,005 B2 * 8/2010 Johnston et al. ..... 52/219
2002/0096242 A1 7/2002 Wasitis et al.
2008/0098673 A1 * 5/2008 Johnston et al. ..... 52/198

* cited by examiner

FLASHING BOOTS FOR ROOF PENETRATIONS

CROSS REFERENCE TO RELATED APPLICATIONS

This application claims the benefit of provisional U.S. Patent Application Ser. No. 60/725,753, filed on Oct. 12, 2005.

STATEMENT REGARDING FEDERALLY SPONSORED RESEARCH OR DEVELOPMENT

N/A

COPYRIGHT NOTICE

A portion of the disclosure of this patent document contains material that is subject to copyright protection. The copyright owner has no objection to the facsimile reproduction by anyone of the patent document or patent disclosure as it appears in the Patent and Trademark Office patent file or records, but otherwise reserves all copyrights rights whatsoever.

BACKGROUND OF THE INVENTION

1. Field of the Invention

The present invention relates to flashing and sealing systems for roof penetrations.

2. Description of Related Art

Flashing is commonly used on roofs at locations where the watertight integrity of the roof is compromised by a penetration, such as a pipe or other penetrating structure. Flashing typically comprises a structure installed in surrounding relation with the penetrating structure to prevent rain water from running down the outside of the penetrating structure and into the building. Plumbing vent pipes and electrical conduits are among the most common penetrating structures.

It has been found that lead provides a particularly suitable material for use in forming flashing structures since lead is pliable and can therefore be easily formed to fit over and around roof penetrating structures while conforming to the roof shape and slope. Lead flashing for a pipe typically includes a base formed from a flat sheet defining a circular hole with a normally projecting hollow cylindrical portion, commonly referred to as the "stack," projecting therefrom. The flashing is typically installed over the pipe such that the base engages a portion of the roof deck with the cylindrical portion in surrounding relation with the pipe. While this configuration is generally suitable for non-metal roofs, the use of lead flashing with metal roof decks has been avoided due largely to increased corrosion resulting from possible electrolytic reactions between dissimilar metals, as well as difficulty in forming a watertight seal between a metal roof deck and a lead flashing base.

In addition, other metallic materials have been used to form flashing. For example, U.S. Pat. No. 5,970,667, issued to Thaler, discloses a split stainless steel flashing system. The flashing consists of two semi-cylindrical sections joined together by clips and resiliently compressible gasket.

The prior art further reveals a number of attempts directed to providing flashing systems fabricated from non-metallic materials in attempts to overcome the above-referenced disadvantages present with the use of metallic materials. For example, U.S. Pat. No. 5,176,408, issued to Pedersen, discloses a seal device fabricated from resilient deformable material for providing a weather seal between a pipe and a surface, such as a roof of a building, through which the pipe extends. The seal device has an apertured base member of resilient material with one end in contact with the roof and the opposite end with an aperture through which the pipe extends. U.S. Pat. No. 5,588,267, issued to Rodriguez, discloses conical roof flashing formed of an elastomeric material, or alternatively made out of a metal base with an elastomeric collar attached to the base.

U.S. Pat. No. 6,279,272, issued to Nill, Jr., discloses a vent pipe flashing system includes a lower flange, a resilient boot portion and a matching sleeve portion. Nill Jr. contemplates fabricating the lower flange of either plastic or metal. A resilient boot, formed of plastic or rubber, is used to connect the lower flange to a sleeve, fabricated from metal or plastic, with a diameter large enough to slide over the vent pipe. Nill Jr. further discloses components that are color matched, and made available in a variety of sizes to fit different size vent pipes.

Finally, U.S. Patent Application Publication No. 2002/0096242, to Wasitis, discloses a penetration pocket assembly for sealing the joint between a membrane covering a roof structure and an element projecting therethrough. The Wasitis assembly includes a rigid ring placed inside a polymeric boot that is equipped with an upper and lower flange. The ring is positioned so that an upper edge fits into the boot upper flange. The ring/boot assembly is then located on the membrane surrounding the projecting element. The ring is sealed to the membrane with an adhesive and a pourable waterproof sealant fills the area within the ring, bonding to the inside surface of the ring, the boot upper flange, the exterior surface of the projecting element, and the membrane.

While the above-referenced flashing systems appear somewhat useful when used in the applications for which they have been designed, there remains a need for improved flashing systems. More particularly, there exists a need for flashing systems specifically designed for use with metal roofs, and color matching flashing systems for use with roofs of various colors. There further exists a need for improved flashing systems for use with non-metal roof systems.

BRIEF SUMMARY OF THE INVENTION

The present invention overcomes the aforementioned limitations and disadvantages present in the art by providing improved flashing for use with metal and non-metal roof systems. In a first embodiment, a lead flashing assembly is provided comprising: a generally planar lead base defining an aperture; a generally cylindrical structure attached to the base in surrounding relation with the aperture and projecting upward therefrom; and an adhesive sealing membrane attached to the bottom of the base for connecting the flashing to a roof. The adhesive sealing membrane is not only effective in securing the flashing to the underlying roof, but further functions as a gasket separating the lead flashing base from a metal roof. This first embodiment is particularly well adapted for use on metal roofs.

In a second embodiment, lead flashing having a generally planar base and upwardly projecting stack is adapted with a non-metallic coating. The coating may comprise any suitable rubber of plastic-type material and may further be colored to match a particular roof color. This second embodiment is suitable for use on virtually any roof system.

In a third embodiment, a flashing structure is fabricated from plastic, and preferably includes a sloped base with a tapered stack. This third embodiment is suitable for use on virtually any roof system. In any of the various embodiments disclosed herein, the base may be angled relative to the stack such that the flashing structure is suitable for use on pitched roofs.

In a fourth embodiment, flashing is formed of a resilient material having a stepped accordion base that allows for the stack to be angularly adjusted relative to the base.

In a fifth embodiment, the stepped accordion base is configured in a partial circumferential configuration on the downward portion of a sloped base, which partial circumferential configuration allows for the stack to be angularly adjusted relative to the base.

In a sixth embodiment, a flashing system is provided with mating top and bottom flashings, each of which includes a stepped accordion base, for use in retrofit applications over existing cylindrical roof penetrations. According to this embodiment, a top flashing member is adapted with a slot running from the bottom base edge through the lower facing side of the stack, and a bottom flashing adapted with a slot running from the top edge through to the upper facing side of the stack. A completed flashing assembly is formed by combining the top and bottom flashing units over an existing roof penetration by slidably positioning the flashing units such that the roof penetration slides through the flashing slots. As should be apparent, any of the embodiments may be adapted with the slotted configuration.

In a seventh embodiment, a one-size-fits-all flashing system is disclosed wherein a flashing base is provided with an elongated triangular stack, resembling the tail of a commercial airliner, is provided for installation on a variety of pitched roofs.

Accordingly, it is an object of the present invention to provide improvements in roof flashing.

Another object of the present invention is to provide roof flashing suitable for use with metal roofs.

Still another object of the present invention is to provide color matched roof flashing suitable for use with metal and non-metal roofs of various colors.

Yet another object of the present invention is to provide improved roof flashing for use with a wide variety of roof systems, including metal roofs, tile roofs, asphalt roofs, and flat roofs.

Another object of the present invention is to provide adjustable flashing systems for use on roofs of various pitches.

Still another object of the present invention is to provide a one-size-fits-all flashing system for roofs of various pitches and roof penetrations of various sizes.

In accordance with these and other objects, which will become apparent hereinafter, the instant invention will now be described with particular reference to the accompanying drawings.

DETAILED DESCRIPTION OF THE INVENTION

With reference now to the drawings, FIGS. 1-30 depict roof flashing systems in accordance with the present invention.

Figure 1:
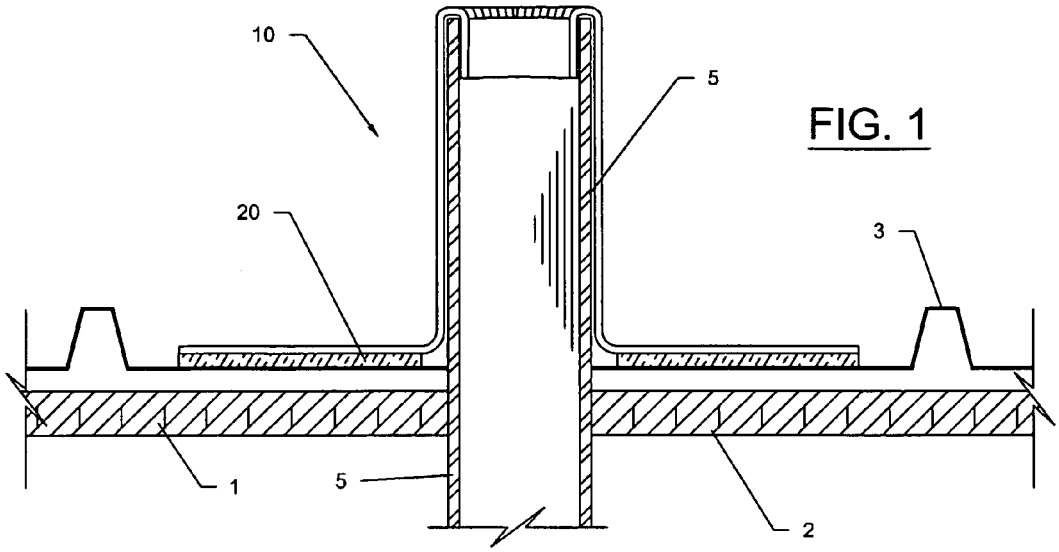
FIG. 1 is a side sectional view of lead flashing adapted with an adhesive sealing membrane in accordance with the present invention installed in connection with a roof deck penetration.
Figure 2:
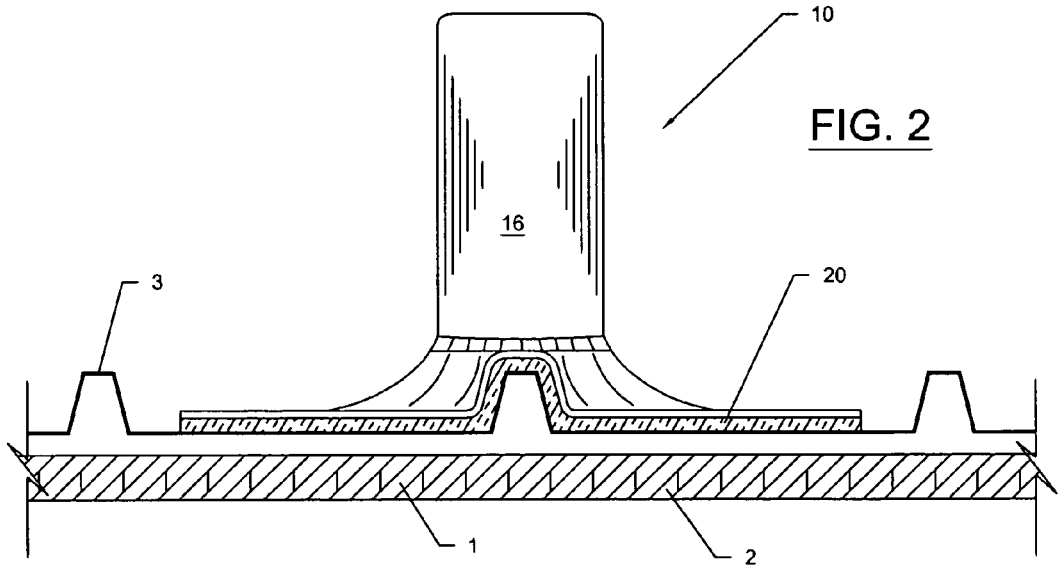
FIG. 2 is a partial side sectional view thereof.
Figure 3:
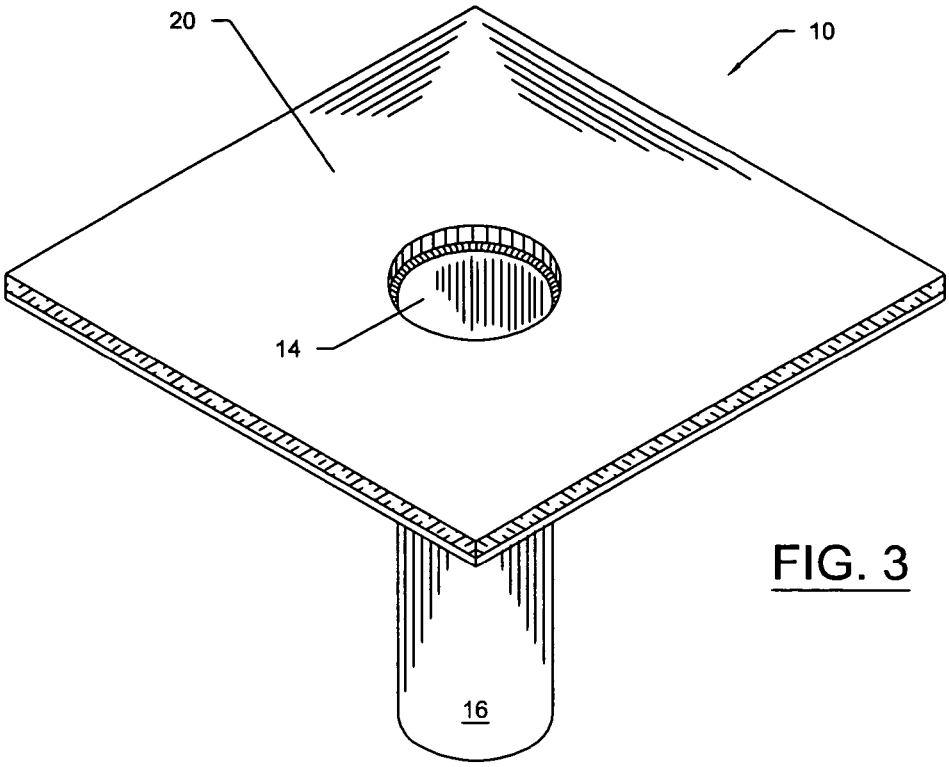
FIG. 3 is a bottom perspective view of the lead flashing adapted with an adhesive sealing membrane.
Figure 4:
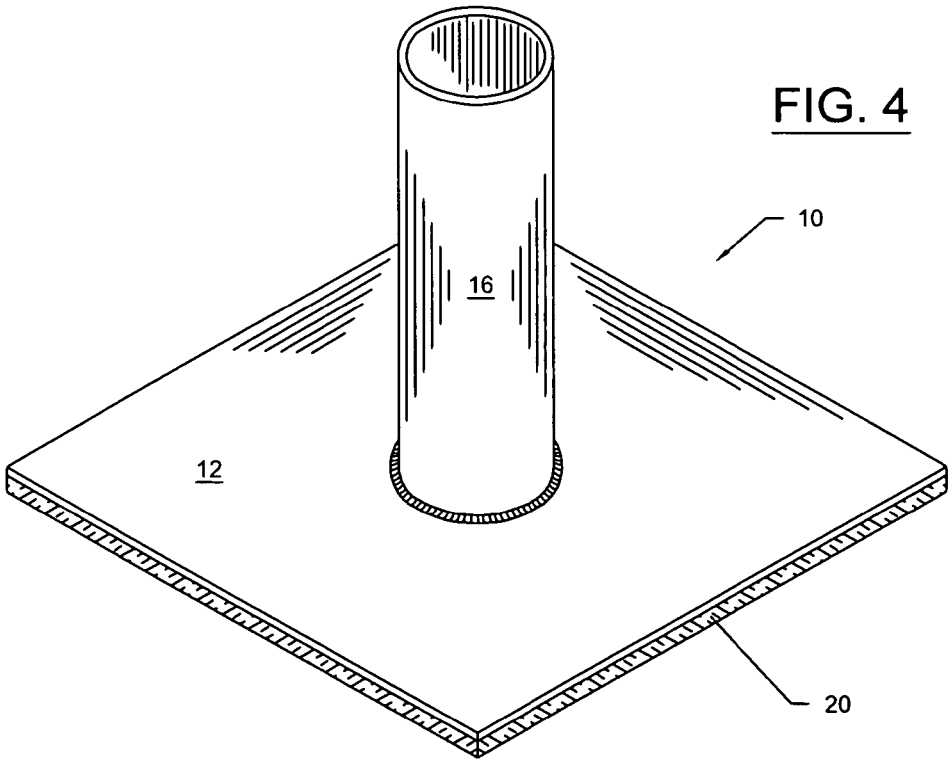
FIG. 4 is a top perspective view thereof.

FIGS. 1-7 disclose lead roof flashing systems that are particularly suitable for use with penetrations in metal roofs. Turning first to FIGS. 1-4, there is depicted a first embodiment roof flashing assembly, generally referenced as 10. FIGS. 1 and 2 depict flashing assembly 10 installed on a roof, generally referenced as 1, including a roof deck 2 and a metal roof surface 3, in relation with a roof penetration, referenced as 5. As best seen in FIGS. 3 and 4, flashing assembly 10 includes a lead flashing structure having a generally planar lead base 12 defining an aperture 14, and a generally cylindrical stack 16 attached to the base in surrounding relation with an aperture 14 and projecting upward from base 12. Base 12 further includes a bottom surface adapted with an adhesive sealing membrane 20 adhesively attached to the bottom of base 12 for connecting the flashing to a roof. Adhesive sealing membrane 20 is preferably initially fabricated with a peel off release paper adapted for removal immediately prior to installation. Adhesive sealing membrane is 20 is preferably a laminate consisting of aluminum foil, high-density polymer films and a thick layer of rubberized asphalt. A suitable adhesive sealing membrane for use with the present invention is available from MFM Building Products under the trademark PEEL & SEAL™. Adhesive sealing membrane 20 has been found to be not only effective in securing flashing 10 to the underlying roof, but further functions as a gasket separating the lead flashing base 12 from the metal roof 3 thereby preventing electrolytic-related corrosion while providing a watertight seal. Sealing membrane 20 further eliminates the need for other fasteners, such as screws and nails, while further eliminating the need for additional sealants such as calk or tar. Flashing assembly 10 is thus particularly adapted for use on metal roofs. Once the flashing is installed the top of the stack is preferably manually bended downward to form a return as best seen in FIG. 1.

Figure 5:
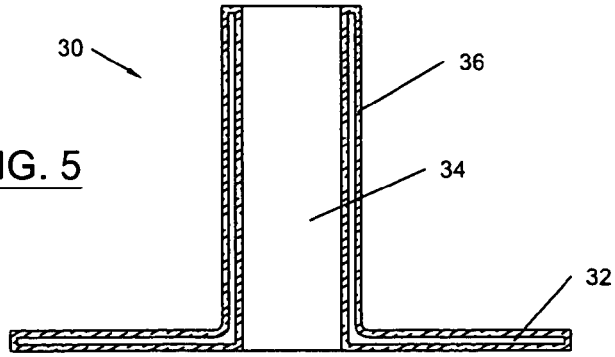
FIG. 5 is a side sectional view of an alternate embodiment of coated roof flashing system.
Figure 6:
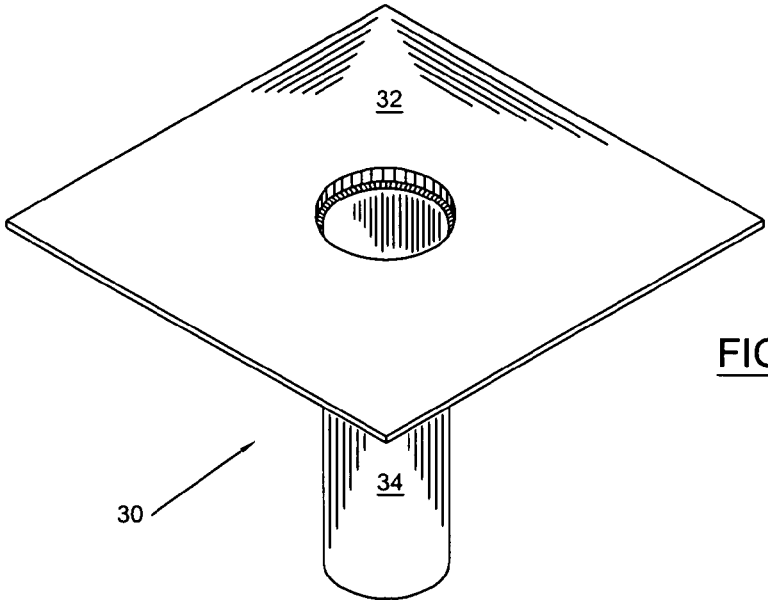
FIG. 6 is a bottom perspective view thereof.
Figure 7:
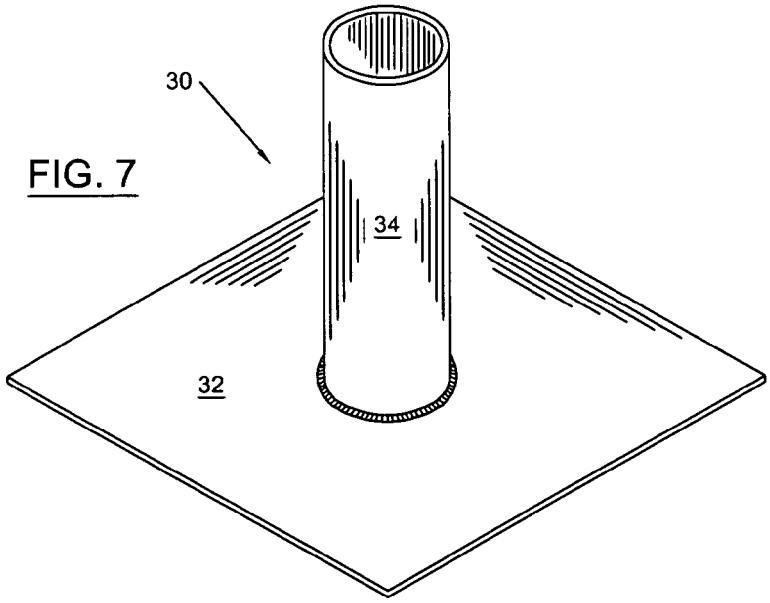
FIG. 7 is a top perspective view thereof.

FIGS. 5-7 depict an alternate embodiment lead flashing assembly, generally referenced as 30. Lead flashing assembly 30 comprises a lead flashing boot having a base 32, a stack 34, and a non-metallic coating 36. Coating 36 preferably comprises a suitable plastic material, such as plasticized vinyl, however, any suitable rubber or plastic-type material is considered within the scope of the present invention. Coating 36 is preferably applied to lead flashing boot 30 by dipping boot 30 into a bath of liquefied coating material to obtain a uniform coating, however, coating 36 may be applied by spray coating or any other suitable application process. Coating 36 may further be colored to match a particular roof color thereby providing a coated lead flashing assembly that matches the roof structure. Coating 36 further functions, upon installation, to provide a barrier between the flashing and the roof, and is particularly beneficial in maintaining separation between the lead flashing boot base 32 and a metal roof deck in metal roof installations. A significant advantage realized with the present invention, and particularly with coating 36, relates to preserving the malleability of the lead flashing assembly without breaking or cracking of coating 36. Accordingly, once the flashing is installed the top of the stack is preferably manually bended downward to form a return as best seen in the embodiment shown in FIG. 1.

Figure 8:
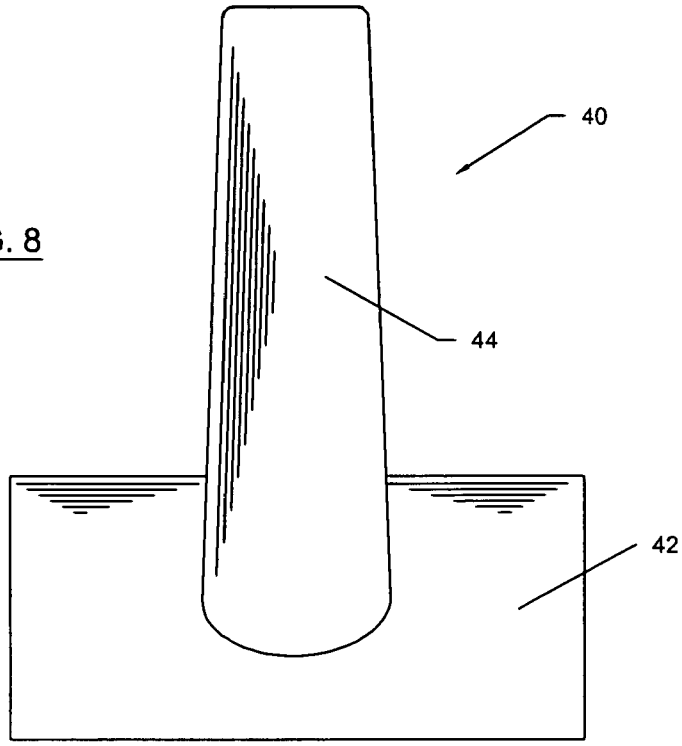
FIG. 8 is a side view of an alternate embodiment plastic roof flashing system in accordance with the present invention.
Figure 9:
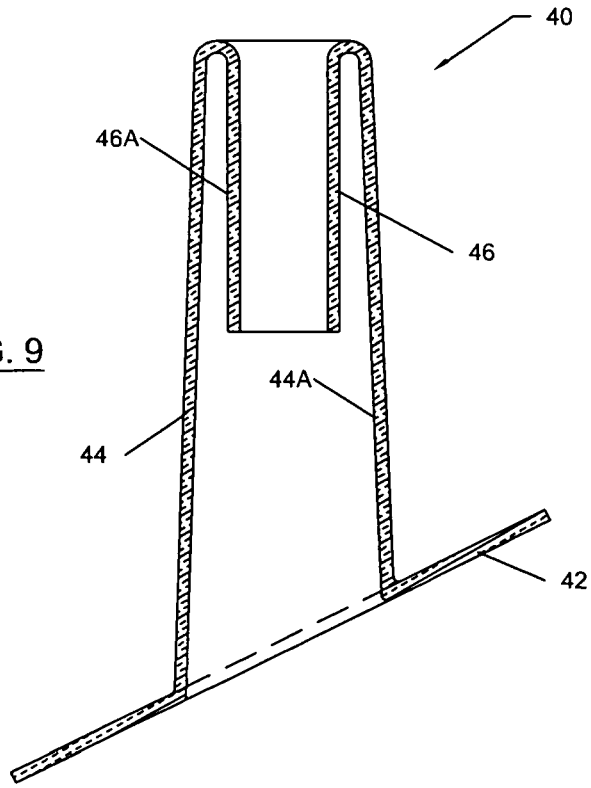
FIG. 9 is a side sectional view thereof.
Figure 10:
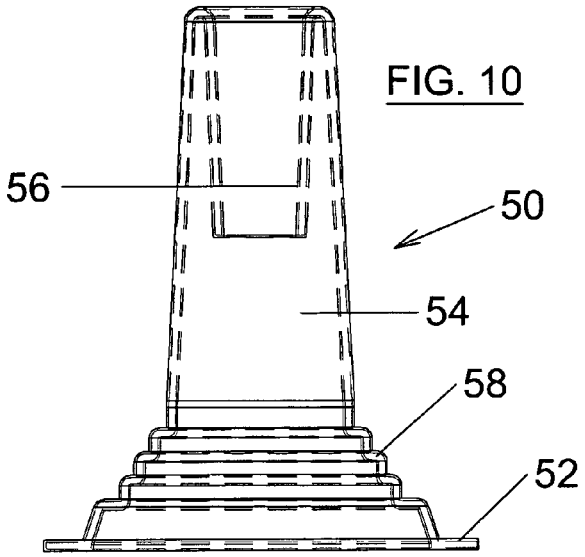
FIG. 10 is a side view of an alternate embodiment angularly adjustable plastic roof flashing system in accordance with the present invention.
Figure 11:
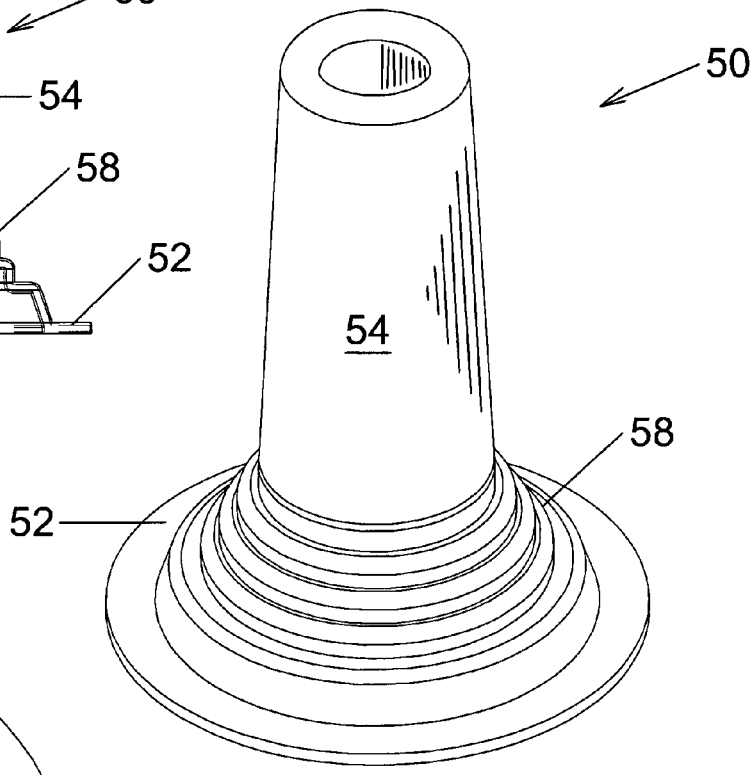
FIG. 11 is a perspective view thereof.
Figure 12:
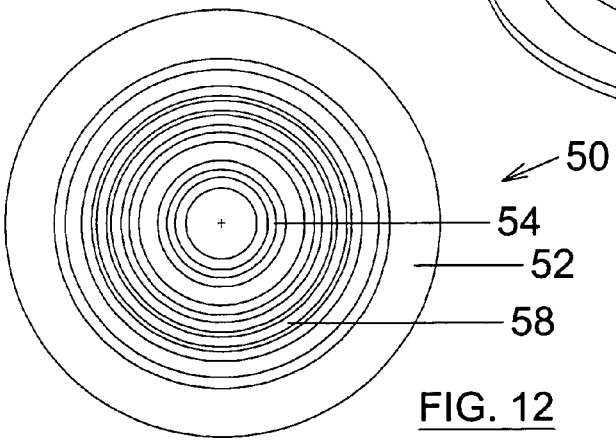
FIG. 12 is a top view thereof.
Figure 13:
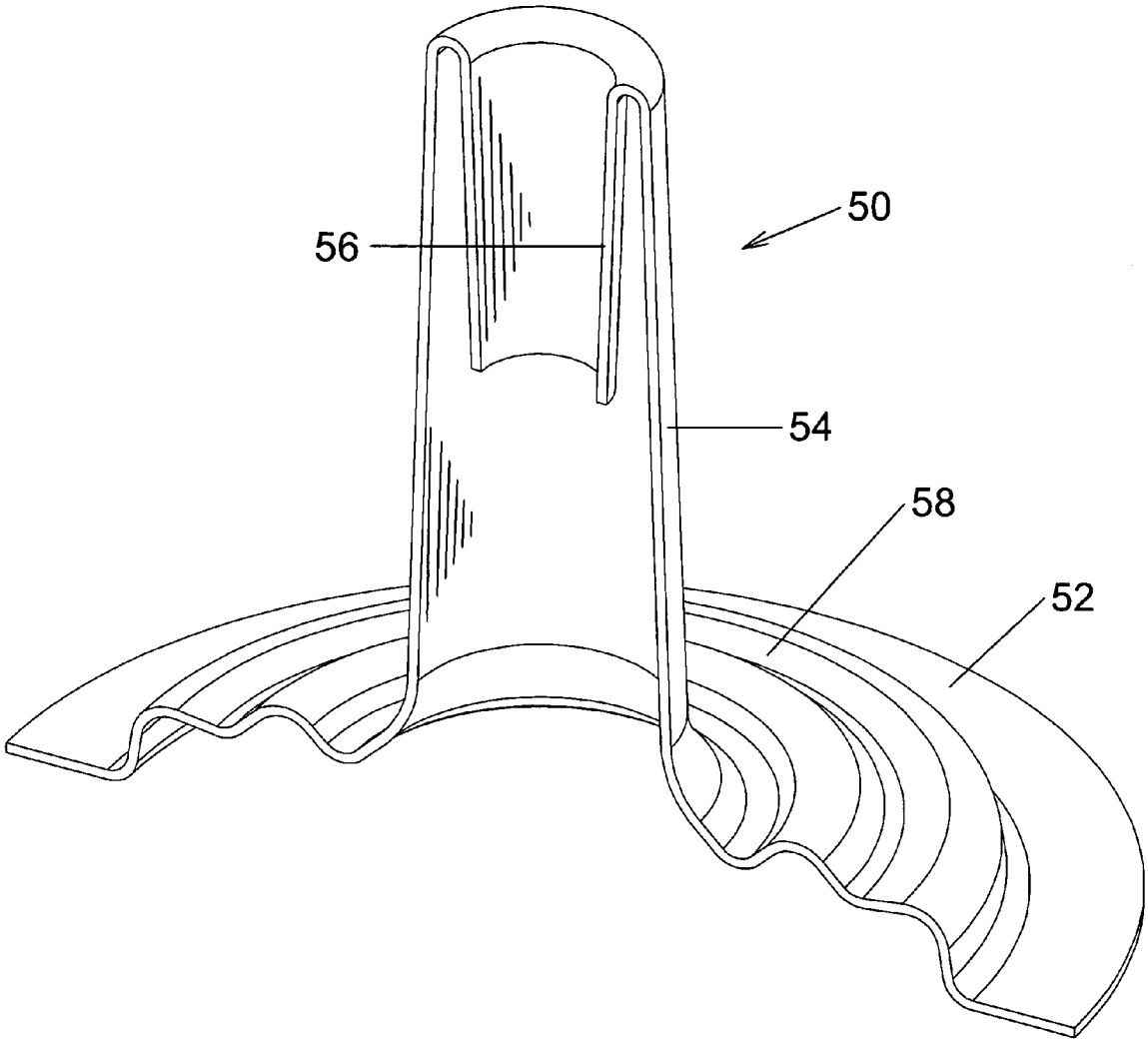
FIG. 13 perspective sectional view thereof.

FIGS. 8 and 9 depict yet another alternate embodiment, namely a plastic flashing boot, generally referenced as 40. Plastic flashing boot 40 is preferably fabricated from colored plastic using suitable molding technique such as injection molding, blow molding, or vacuum molding. Plastic flashing boot 40 includes a base 42, a stack 44, and a stack return 46. A significant aspect of the embodiment includes the provision of a prefabricated stack return structure 46, particularly since the plastic material is generally not suited for manual bending to form the stack return. In embodiments intended for installation with sloped roofs, base 42 is preferably angled relative to stack 44 as best illustrated in FIG. 9. Stack 44 is preferably generally cylindrical and tapered such that the diameter of the stack decreases from the base portion (adjacent base 42) to the top portion. Stack return 46 is essentially bent within stack 44 and has an outer surface 46A disposed in spaced relation with the inner surface 44A of stack 44. Since stack 44 is tapered the gap existing between the outer surface of stack return 46 and the inner surface 44A of stack 44 decreases (e.g. narrows) as the distance from base 42 increases. Accordingly, when plastic flashing boot 40 is installed over a pipe, the top of the pipe in inserted between the inner surface 44A of stack 44 and the outer surface 46A and ultimately brought in sealing engagement with surfaces 44A and 46A thereby forming a seal.

FIGS. 10-13 depict another alternate embodiment, namely an angularly adjustable flashing system, generally referenced as 50. Flashing system 50 is preferably fabricated from a weather resistant resilient material, such as UV resistant plastic. Flashing system 50 includes a circular base 52, a tapered cylindrical stack 54 projecting upward from base 52 and terminating in a stack return 56. Stack 54 is connected to base 52 by an stepped accordion section 58 such that stack 54 is angularly adjustable relative to base 52 so as to be adaptable to a variety of roof pitch configurations. The circular/cylindrical shape of base 52, and stepped accordion section 58, allow stack 54 to be angularly adjusted in any 360-degree direction. In an alternate embodiment, base 52 may further be adapted with a pliable metal ring (not shown) that allows the base to become bendable into a particular shape so as to conform to the ridges of a metal roof.

Figure 14:
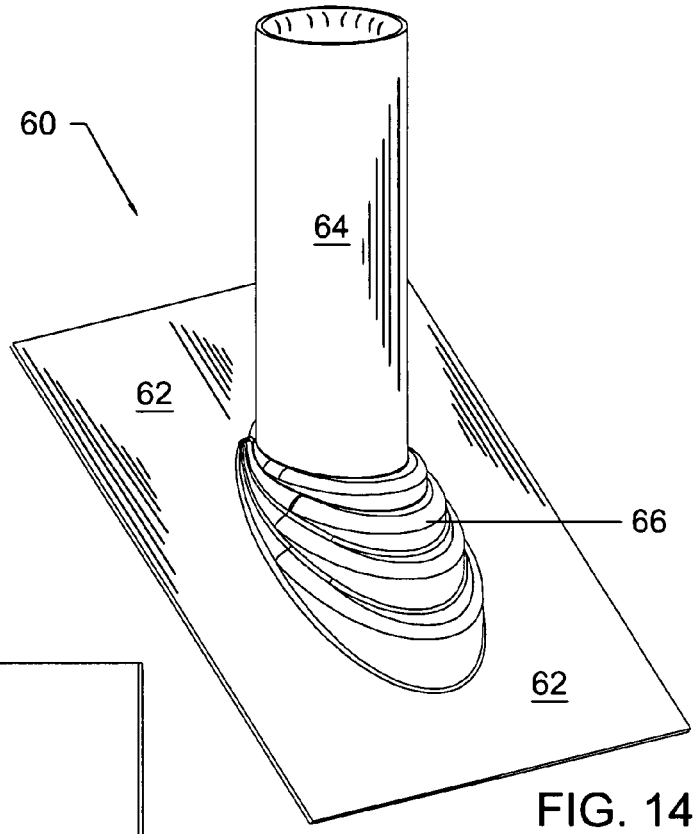
FIG. 14 is a perspective view of an alternate embodiment angularly adjustable plastic roof flashing in accordance with the present invention.
Figure 15:
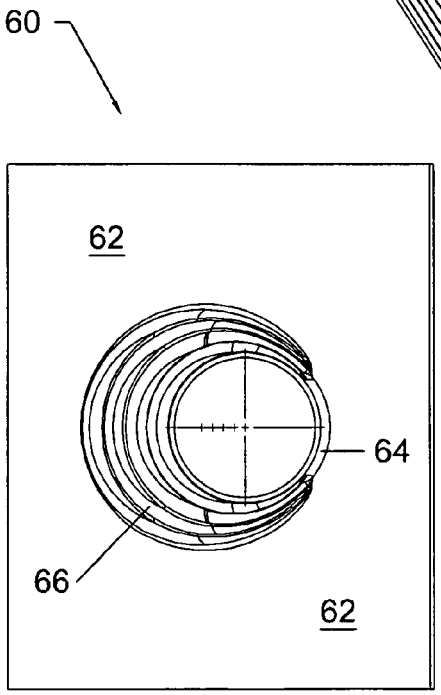
FIG. 15 is a top view thereof.
Figure 16:
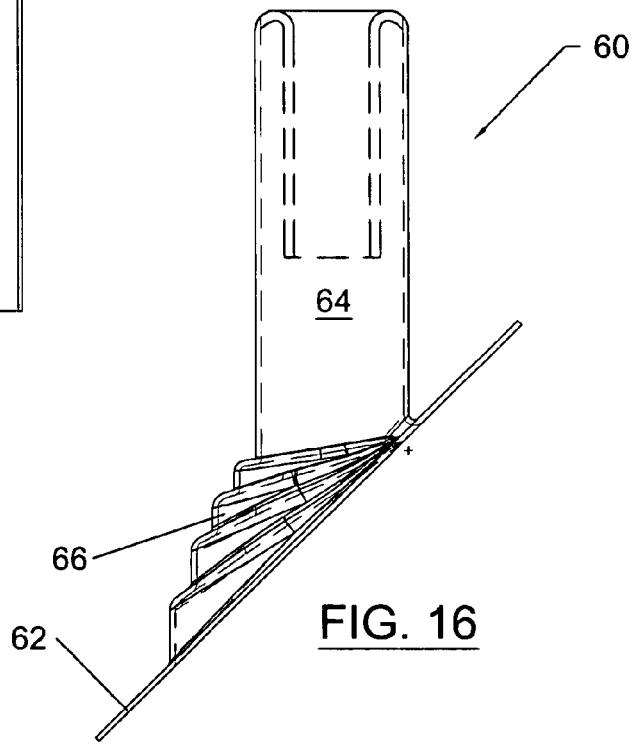
FIG. 16 is a side view thereof.
Figure 17:
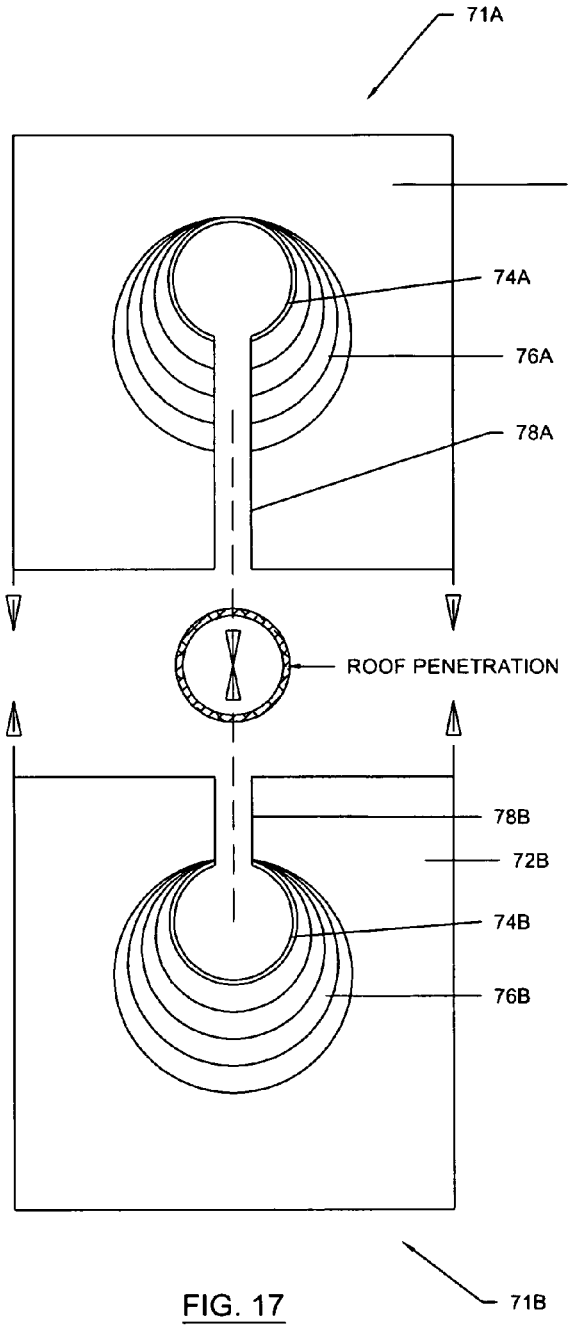
FIGS. 17 and 18 are top views illustrating a two-piece split flashing system comprising top and bottom flashing members for use in retrofit installations.
Figure 18:
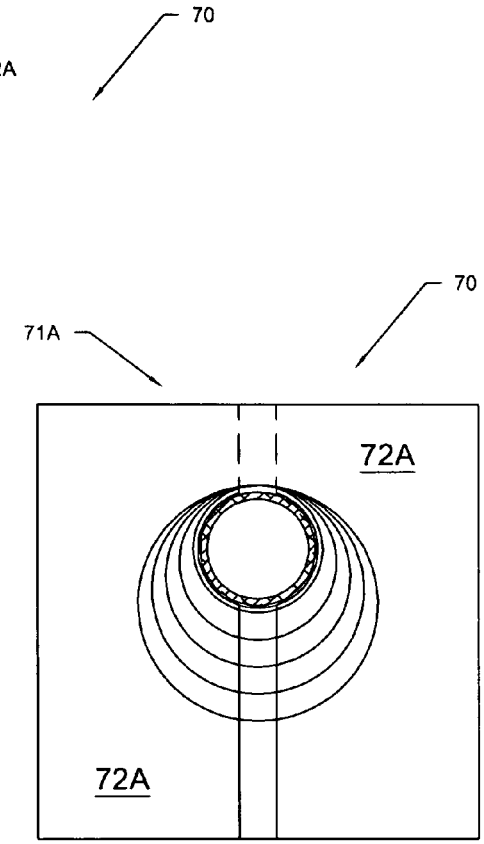
Figure 19:
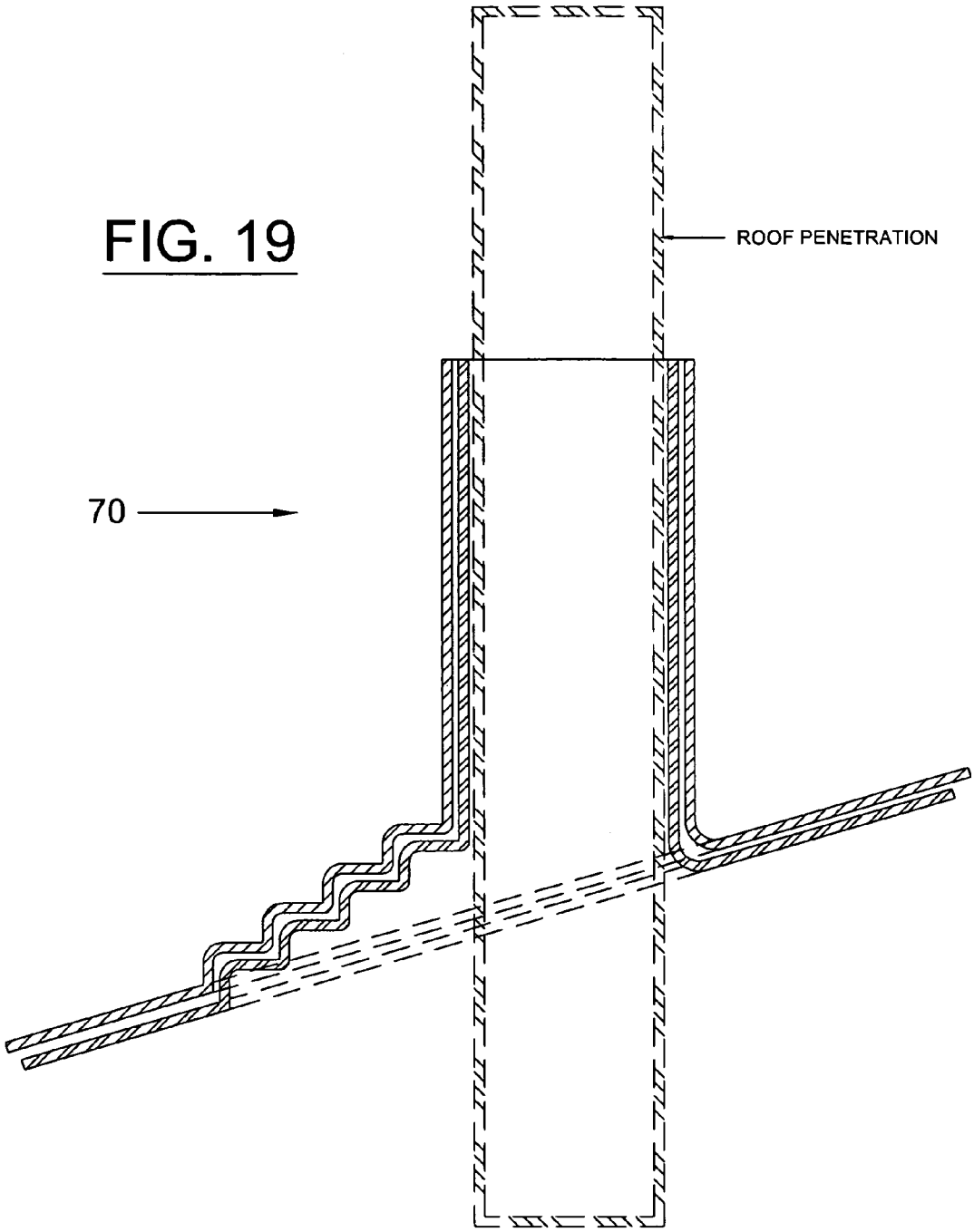
FIG. 19 is a side sectional view of the two-piece split flashing system installed on a roof.
Figure 20:
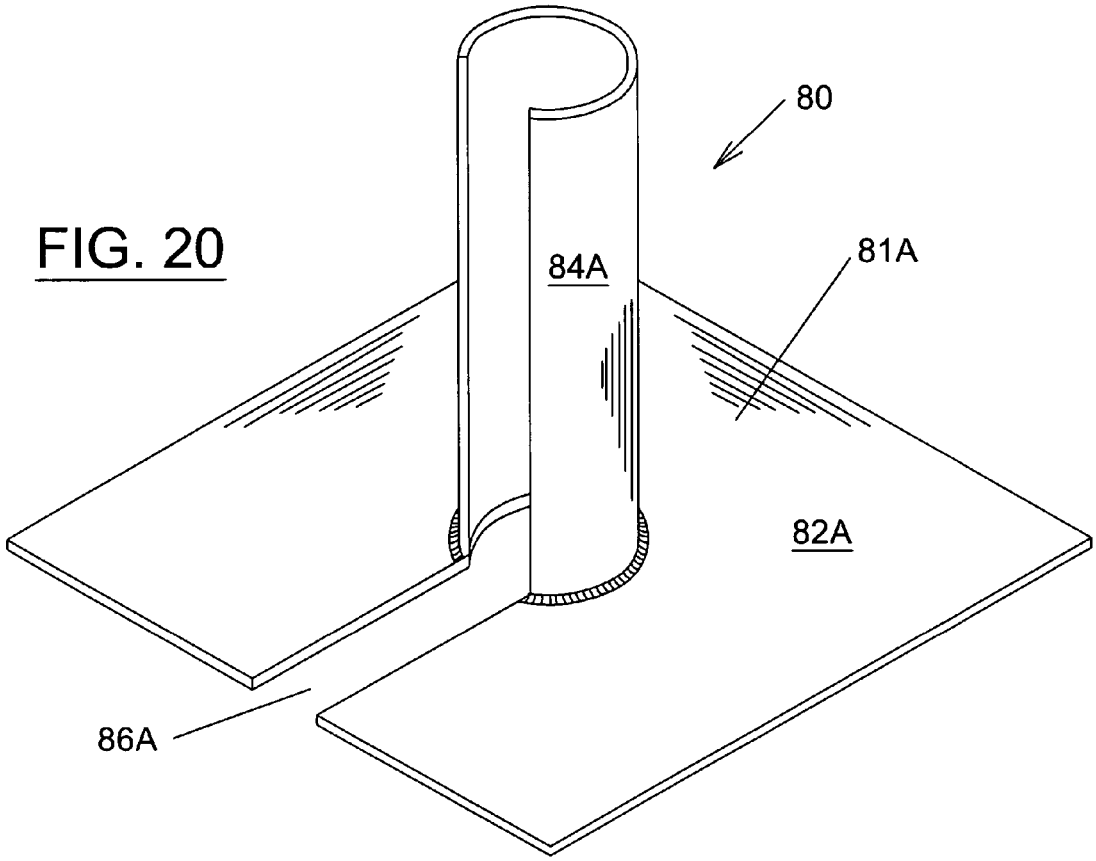
FIGS. 20-24 depict an alternate embodiment two-piece slotted flashing system in accordance with the present invention.
Figure 21:
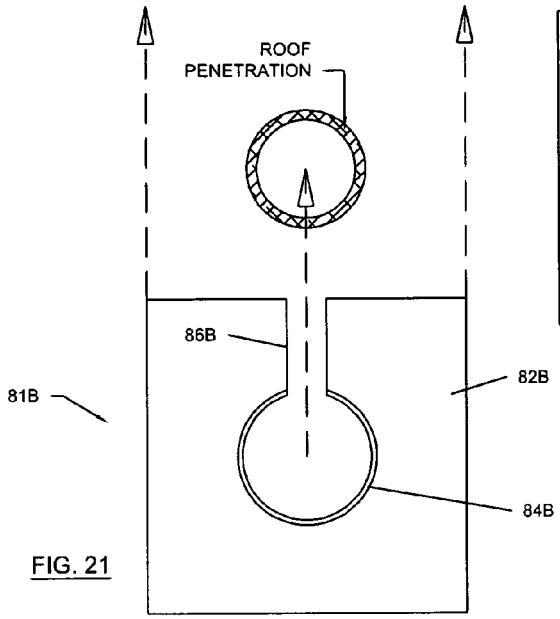

FIGS. 14-16 depict an alternate embodiment wherein an adjustable flashing, generally referenced as 60, is provided. Flashing system 60 is preferably fabricated from a weather resistant resilient material, such as UV resistant plastic. Flashing system 60 includes a base 62, a generally cylindrical stack 64 projecting upward from base 62. Stack 64 is connected to base 62 by an stepped accordion section 66 such that stack 64 is angularly adjustable relative to base 62 so as to be adaptable to a variety of roof pitch configurations. In this embodiment, stepped accordion section 66 is configured in a partial circumferential configuration on the downward portion of a sloped base, which partial circumferential configuration allows for the stack to be angularly adjusted relative to the base, primarily in up-slope or down-slope directions FIGS. 17-19 depict an alternate embodiment two-piece split flashing system, generally referenced as 70, having mating top and bottom flashing members, referenced as 71A and 71B respectively. Top and bottom flashing members 71A and 71B are adapted for retrofit installations in surrounding relation with an existing roof penetration as best illustrated in FIGS. 17 and 18. In a preferred embodiment, flashing member 71A includes a base 72A, a generally cylindrical stack 74A upwardly projecting from said base, a flexible accordion hinge 76A, and a slot 78A running from the lower edge of top flashing 71A completely through the lower side of stack 74A. Flashing member 71B includes a base 72B, a generally cylindrical stack 74B upwardly projecting from said base, a flexible accordion hinge 76B, and a slot 78B running from the upper edge of top flashing 71B completely through the upper side of stack 74B. Bases 72 may be initially fabricated generally perpendicular to stacks 74 for use on generally flat surfaces and roofs, or alternatively bases 72 may be disposed in angular relation with stacks 74 for use on sloped surfaces and roofs. Slots 78A and 78B allow flashing members 71A and 71B to be installed around an existing roof penetration by providing space for the roof penetration to slide into position within the stack portion. A completed flashing assembly is formed by combining the top and bottom flashing units over an existing roof penetration by slidably positioning the flashing units such that the roof penetration slides through the flashing slots. In a preferred installation, bottom flashing member 71B is initially installed in position around the roof penetration and top flashing member 71A is installed in overlapping relation with bottom flashing member 71B as illustrated in FIGS. 17 and 18 to form a completed assembly. FIG. 19 is a side sectional view of a two-piece split flashing system according to the present invention installed in covering relation with a roof penetration.

Figure 22:
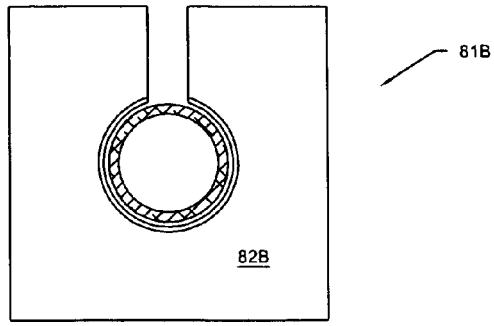
Figure 23:
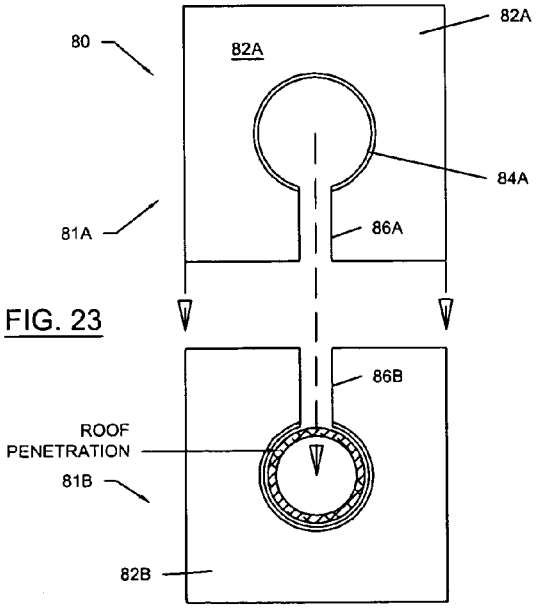
Figure 24:
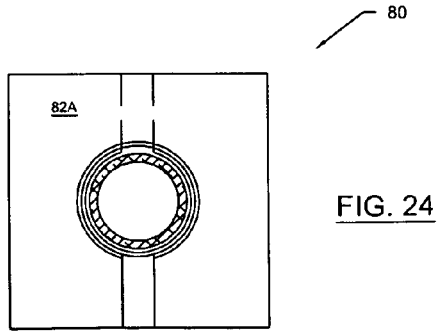
Figure 25:
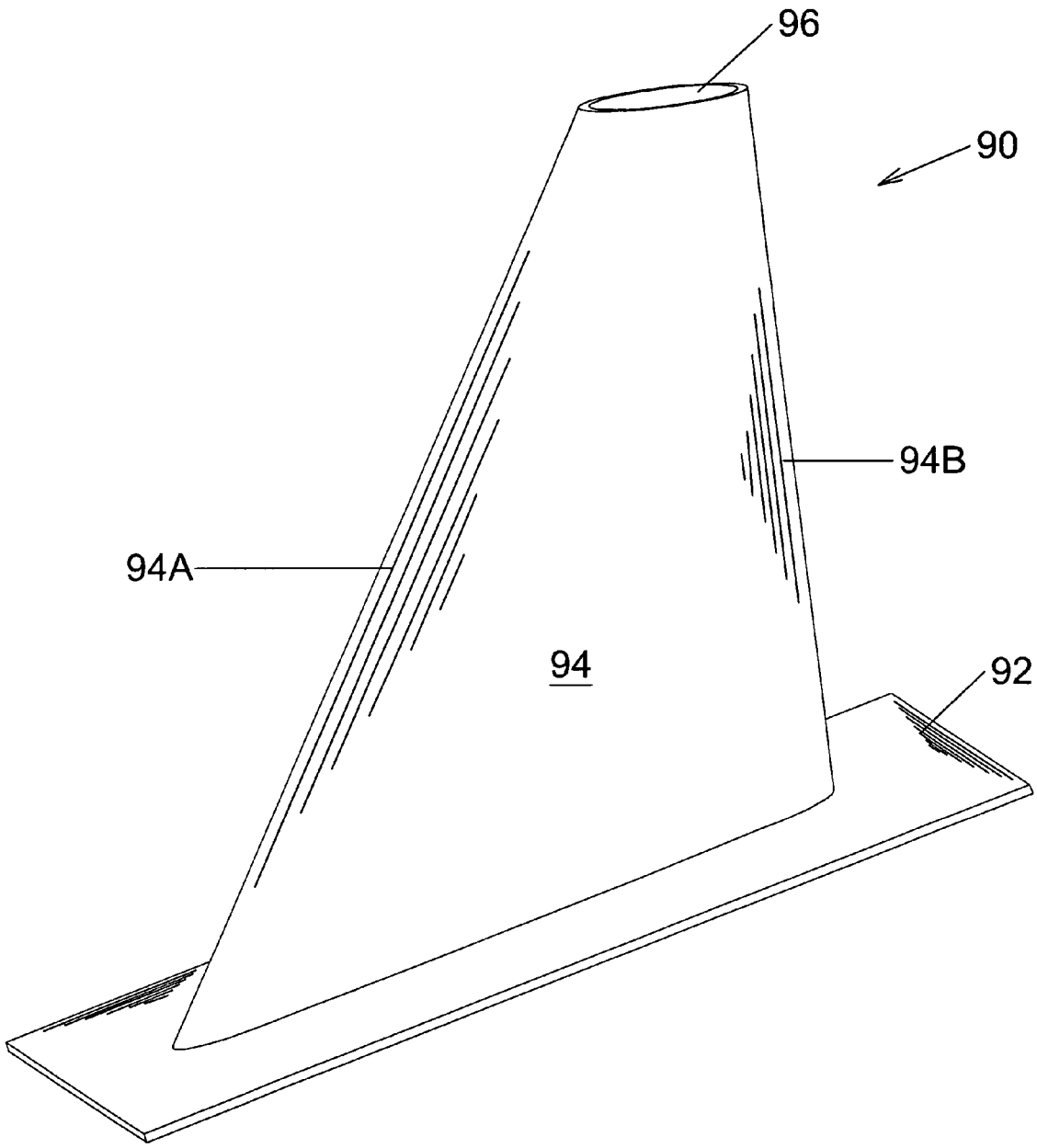
FIG. 25 is a perspective view of a one-size-fits-most flashing system for installation on a variety of pitched roofs.
Figure 26:
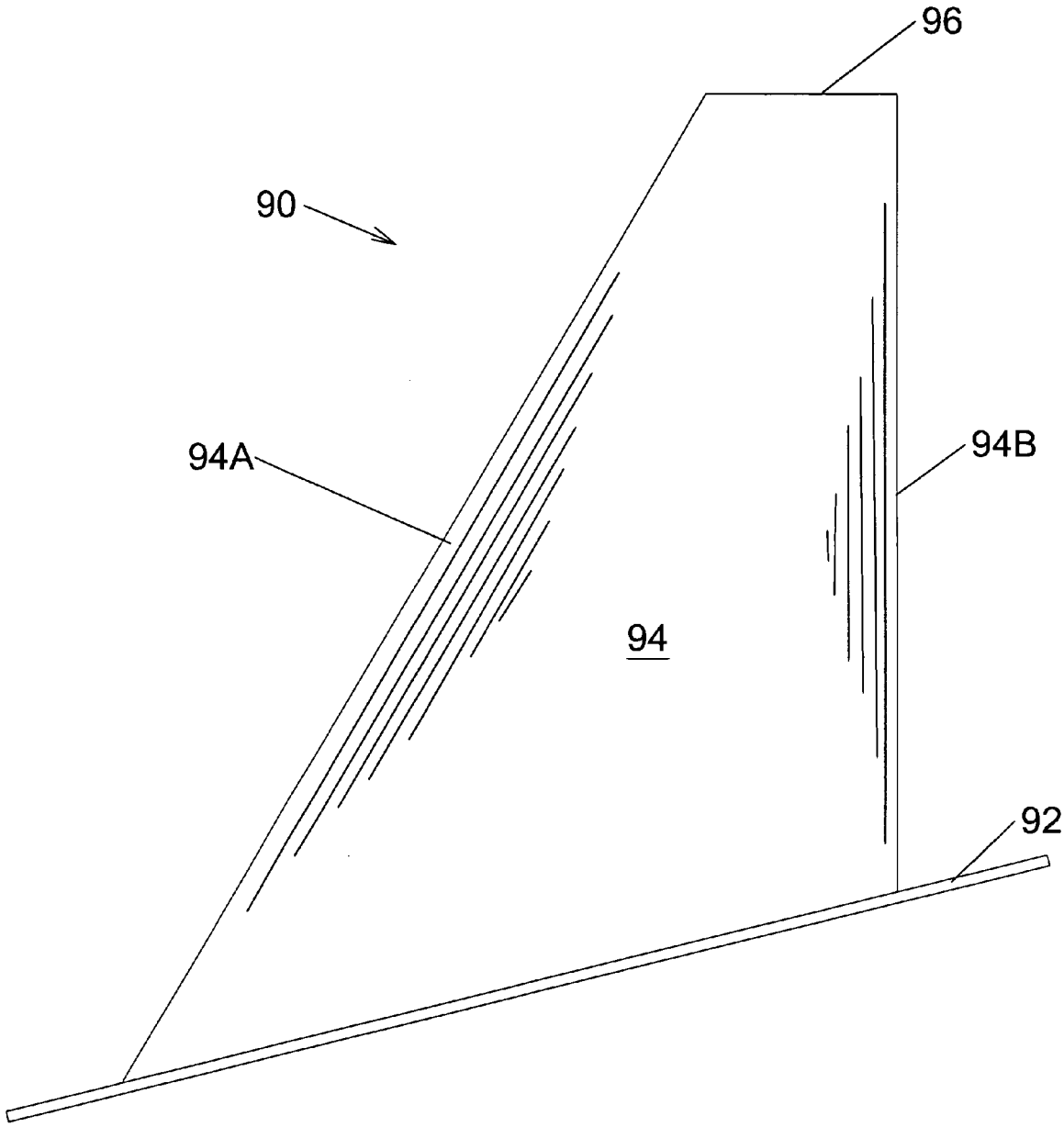
FIG. 26 is a side elevational view thereof.

FIGS. 20-24 depict another alternate embodiment two-piece split flashing system, generally referenced as 80, adapted for use in flat roof retrofit applications. Flashing system 80 includes mating top and bottom flashing members, referenced as 81A and 81B respectively. Top and bottom flashing members 81A and 81B are adapted for retrofit installations in surrounding relation with an existing roof penetration as best illustrated in FIGS. 22-24. In a preferred embodiment, flashing member 81A includes a base 82A, a generally cylindrical stack 84A upwardly projecting from said base in perpendicular relation therewith, and a slot 86A running from the lower edge of top flashing 81A completely through the lower side of stack 84A. Flashing member 81B includes a base 82B, a generally cylindrical stack 84B upwardly projecting from said base, and a slot 86B running from the upper edge of top flashing 81B completely through the upper side of stack 84B. Bases 82 may be initially fabricated generally perpendicular to stacks 84 for use on generally flat surfaces and roofs, or alternatively bases 82 may be disposed in angular relation with stacks 84 for use on sloped surfaces and roofs. Slots 86A and 86B allow flashing members 81A and 81B to be installed around an existing roof penetration by providing space for the roof penetration to slide into position within the stack portion. A completed flashing assembly is formed by combining the top and bottom flashing units over an existing roof penetration by slidably positioning the flashing units such that the roof penetration slides through the flashing slots. In a preferred installation, bottom flashing member 81B is initially installed in position around the roof penetration and top flashing member 81A is installed in overlapping relation with bottom flashing member 81B as illustrated in FIGS. 22, 23, and 24 to form a completed assembly.

FIGS. 25-30 depict an alternate embodiment one-size-fits-most flashing system, generally referenced as 90, for use with roof penetrations on a variety of differently sloped roof configurations. Flashing system 90 is preferably fabricated from a weather resistant resilient material, such as UV resistant plastic, and alternatively may be fabricated from metal material such as copper or lead. Flashing system 90 includes a base 92, a generally triangular hollow stack 94 projecting upward from base 92 and terminating in a stack return 95 defining an open top 96. Stack 94 is directly connected to base 92 such that stack 94 is angularly disposed relative to base 92. Stack 94 includes a lower or bottom edge 94A and a top or upper edge 94B that combine to form an irregular truncated conical structure defining an open top 96 so as to be adaptable to a variety of roof pitch configurations. More particularly, stack 94 includes a lower stack edge 94A that intersects base 92 at an obtuse angle and an upper stack edge 94B that intersects base 92 at a generally right angle. The combination of angular configurations presented by stack 94 allows flashing 90 to be installed with roof penetrations existing on a variety of sloped roof configurations.

Figure 27:
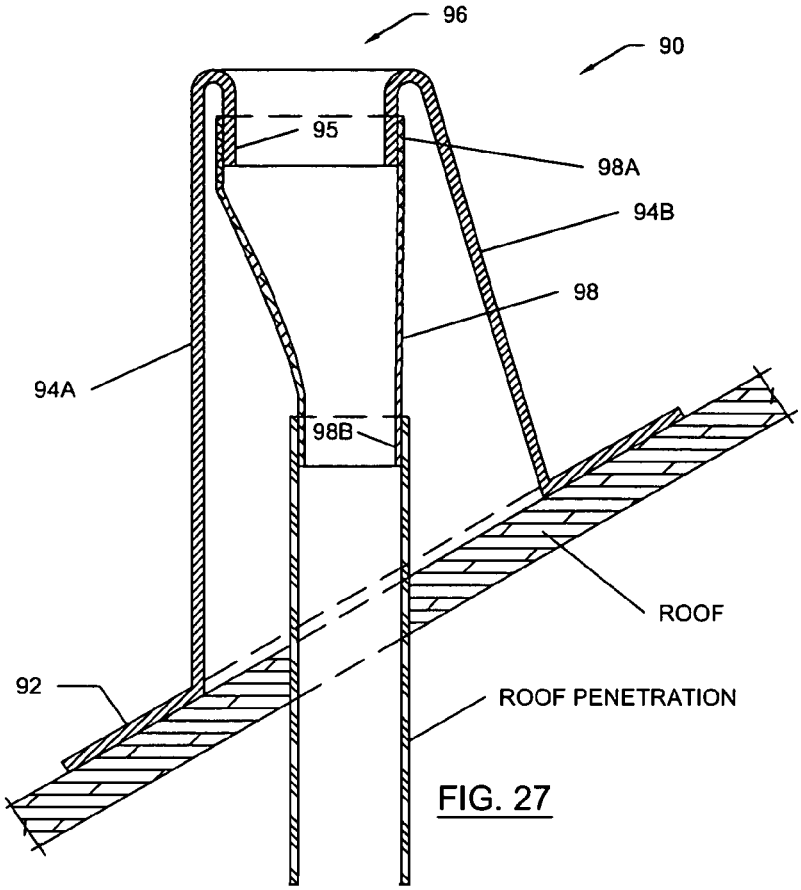
FIGS. 27 and 28 are side sectional views of the one-size-fits-most flashing system in two differing installed configurations.
Figure 28:
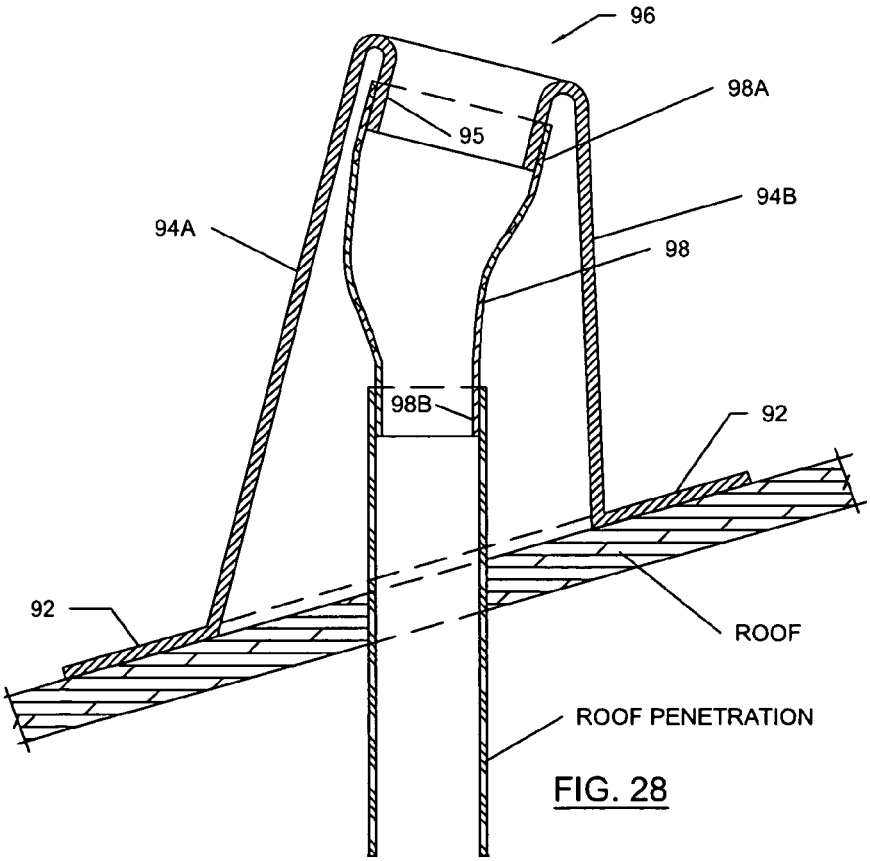
Figure 29:
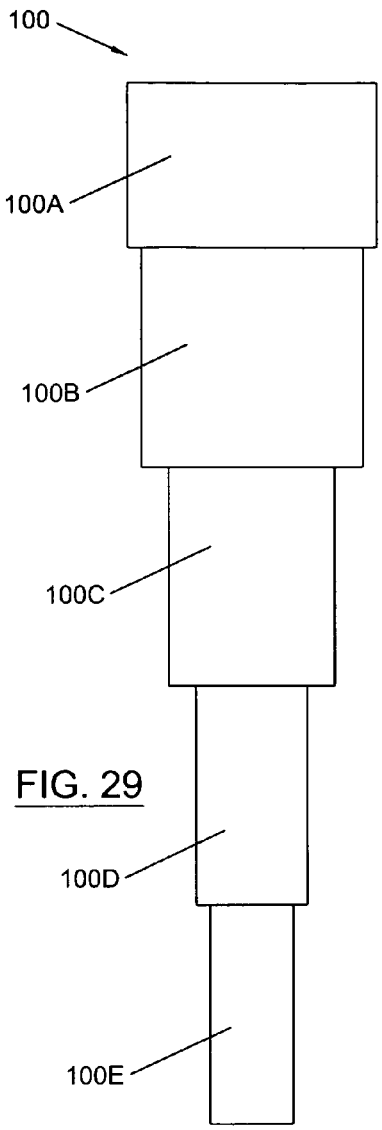
FIG. 29 depicts an alternate connection plastic downspout suitable for use with multiple diameter roof penetrations.
Figure 30:
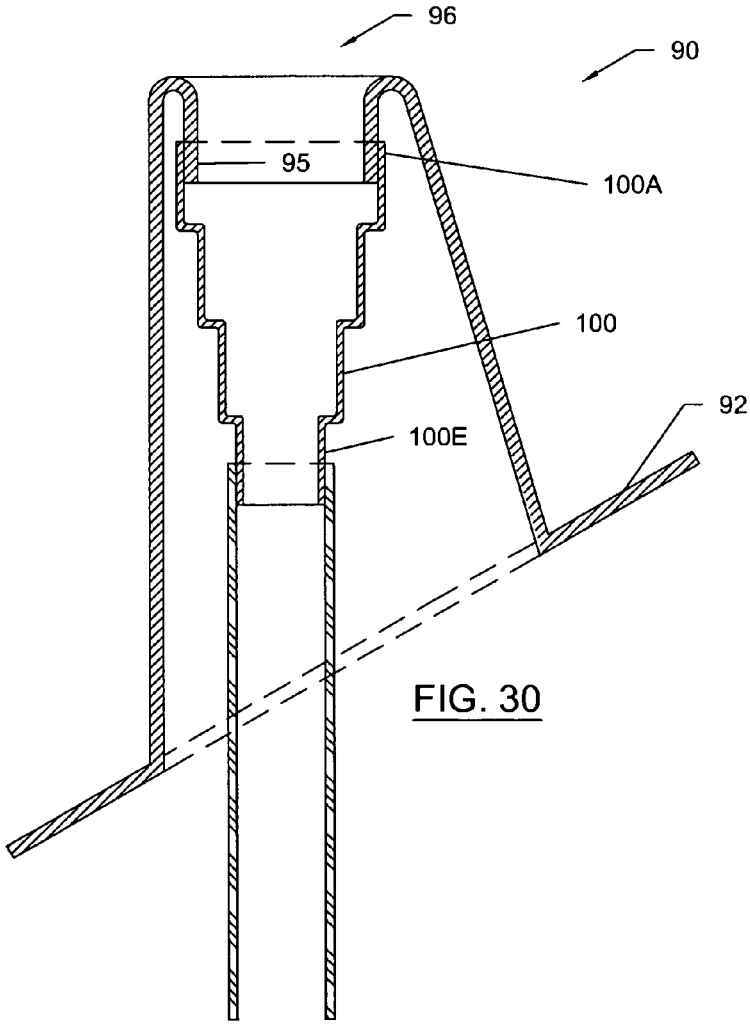
FIG. 30 is a side sectional view of the one-size-fits-most flashing system installed on a roof penetration with the alternate connection plastic downspout depicted in FIG. 29.

As best depicted in FIGS. 27 and 28 flashing system 90 further includes a flexible connection plastic downspout, referenced as 98, having a first end 98A connected to stack return 95 and a second end 98B connected to the roof penetration. The use of a flexible connection plastic downspout allows flashing system 90 to further adapt to various roof slope and roof penetration configurations. In accordance with a further embodiment, an alternate flexible stepped plastic downspout, referenced as 100, is disclosed for connecting flashing system 90 to a cylindrical roof penetration. FIG. 29 depicts a flexible stepped plastic downspout 100 in accordance with the present invention. Stepped plastic downspout 100 includes a generally cylindrical first end 100A adapted for mating connection with stack return 95 and a plurality of diametrically reducing steps sections, referenced as 100B, 100C, 100D, and 100E, each of which forms a generally cylindrical section of a specific diameter. In a preferred embodiment, section 100A is sized to fit stack return 95 of flashing system 90. In addition, section 100B is preferably sized to fit a 4-inch diameter pipe, section 100C is sized to fit a 3-inch diameter pipe, section 100D is sized to fit a 2-inch diameter pipe, and section 100E is sized to fit a 1½ inch diameter pipe. During installation the installing technician is able to simply cut the stepped plastic downspout to the size that will accommodate the roof penetration pipe.

As should now be apparent, the various embodiments disclosed herein provide improved flashing boot structures for use with a wide variety of roof systems, including metal roofs, tile, shingle, and asphalt roof systems. In addition, the flashing boot structures may be colored and adapted with any suitable textured surface to match any roof.

The instant invention has been shown and described herein in what is considered to be the most practical and preferred embodiment. It is recognized, however, that departures may be made therefrom within the scope of the invention and that obvious modifications will occur to a person skilled in the art.

What is claimed is:

1. A flashing assembly comprising:

a roof penetrating pipe formed about a generally vertical longitudinal axis terminating in an open top; and a flashing apparatus including:

a base defining a generally elongate aperture;

a monolithic stack projecting upward from said base, said stack including a bottom connected to said base in surrounding relation with said elongate aperture, and an open top portion;

said stack connected to said base in an angular configuration;

said stack forming a generally triangular hollow stack projecting upward from said base and terminating in a truncated top having a generally cylindrical flexible stack return having a plurality of diametrically reducing step sections projecting downward within said stack, said flexible stack return being inserted into the open top of the roof penetrating pipe without requiring axial alignment with the open top of said roof penetrating pipe; and said generally triangular stack defined by a generally linear lower rounded edge converging relative to a generally linear upper rounded edge, which edges combine with said top and said base to form an irregular truncated conical structure terminating at said open top so as to be adaptable to a variety of roof pitch configurations.

2. A roof flashing assembly comprising:

a roof penetrating pipe formed about a generally vertical longitudinal axis terminating in an open top; and a flashing apparatus including:

a base defining a generally elongate aperture;

a generally triangularly-shaped hollow stack projecting upward from said base, said stack including a bottom connected to said base in surrounding relation with said elongate aperture, and a truncated open top portion;

said stack having a lower bottom edge and an upper bottom edge, said stack connected to said base in an angular configuration with the lower bottom edge forming an obtuse angle with said base and the upper bottom edge forming an acute angle with said base;

a generally flexible down spout return formed about a longitudinal axis projecting from said open top generally downward within said stack, said down spout return having stepped reductions in diameter as said down spout return extends downward;

wherein when said flashing apparatus is installed said base sealingly engages the roof, and the down spout return is insertedly disposed within the roof penetrating pipe without requiring axial alignment between the generally vertical longitudinal axis of said pipe and the longitudinal axis of said down spout return.

* * * * *